US008746546B2

(12) United States Patent
Kartes

(10) Patent No.: US 8,746,546 B2
(45) Date of Patent: Jun. 10, 2014

(54) FOOD CONTAINER

(75) Inventor: Kristin L. Kartes, Kalamazoo, MI (US)

(73) Assignee: Arvco Container Corporation, Kalamazoo, MI (US)

( * ) Notice: Subject to any disclaimer, the term of this patent is extended or adjusted under 35 U.S.C. 154(b) by 585 days.

(21) Appl. No.: 12/688,141

(22) Filed: Jan. 15, 2010

(65) Prior Publication Data

US 2011/0174871 A1 Jul. 21, 2011

(51) Int. Cl.
*B65D 5/64* (2006.01)
*B65D 5/56* (2006.01)

(52) U.S. Cl.
USPC ..... 229/141; 229/150; 229/5.81

(58) Field of Classification Search
CPC ..... B65D 5/241; B65D 5/0254; B65D 5/302; B65D 5/22; B65D 5/244; B65D 5/248; B65D 5/2052; B65D 5/3657
USPC ..... 229/141, 916, 917, 150, 186, 187
See application file for complete search history.

(56) References Cited

U.S. PATENT DOCUMENTS

| | | | | |
|---|---|---|---|---|
| 3,137,435 | A * | 6/1964 | Meyers | 229/113 |
| 3,542,569 | A * | 11/1970 | Farquhar | 426/115 |
| 4,347,968 | A * | 9/1982 | Cornell et al. | 229/167 |
| 4,489,879 | A | 12/1984 | Mode | |
| D312,213 | S | 11/1990 | Forbes, Jr. | |
| 5,226,588 | A * | 7/1993 | Schramm et al. | 229/149 |
| 5,452,845 | A * | 9/1995 | Ritter | 229/110 |
| 5,752,651 | A | 5/1998 | Correll | |
| 5,921,466 | A | 7/1999 | Speese et al. | |
| 6,065,669 | A | 5/2000 | Correll | |
| 6,533,164 | B1 | 3/2003 | Correll | |
| 7,464,855 | B2 | 12/2008 | Glasgow | |
| 7,562,808 | B1 * | 7/2009 | Philips | 229/148 |
| 7,757,860 | B2 * | 7/2010 | Philips | 206/562 |
| 2006/0169754 | A1 * | 8/2006 | Tseng | 229/112 |
| 2008/0048013 | A1 | 2/2008 | Hanna et al. | |
| 2008/0296358 | A1 | 12/2008 | Hanna | |

OTHER PUBLICATIONS

Two photographs ("A" and "B") Breadbowl Pasta Box (date unknown) (2 sheets).

* cited by examiner

*Primary Examiner* — Gary Elkins
*Assistant Examiner* — Christopher Demeree
(74) *Attorney, Agent, or Firm* — Flynn, Thiel, Boutell & Tanis, P.C.

(57) ABSTRACT

A fully erected one-piece, four wall container made of a foldable material having a tray with a bottom wall panel, a front wall, a rear wall and two side walls. Each of the front wall, the two side walls and the rear wall are configured to be folded to a position that is perpendicular to the bottom wall panel. Locations on the front wall and the rear wall that are mutually adjacent the first and second side walls each have a triangular piece hingedly joined thereto and to a respective one of the first and second side walls. Each triangular piece is configured to be oriented perpendicular to respective first and second side walls and parallel to respective front and rear walls, all in response to each of the front, rear and first and second side walls becoming oriented perpendicular to the bottom wall panel.

12 Claims, 7 Drawing Sheets

FOOD CONTAINER

FIELD OF THE INVENTION

This invention relates to a container and, more specifically, a fully erected four wall container made of a foldable material and formed from a one-piece blank.

BACKGROUND OF THE INVENTION

This invention arose out of a need to provide to the marketplace a container made of a foldable material and formed from a one-piece blank that is capable of housing therein products that are sold in a somewhat wet or juicy state, such as clams, fish and the like. Such products have a tendency to discharge a liquid substance that can leak from the bottom wall panel and/or through openings formed between the bottom wall panel and surrounding walls of the container that the products have been placed into at the time of the sale, particularly the type of container that has been formed from a one-piece blank.

Accordingly, it is a desire of this invention to provide to the marketplace a container formed from a one-piece blank of foldable material that will facilitate the housing of wet or juicy products without leakage of the liquid substance through the bottom wall panel and/or through openings formed between the bottom wall panel and adjacent side walls of the folded container.

SUMMARY OF THE INVENTION

The objects and purposes of the invention are met by providing a fully erected one-piece, four wall container made of a foldable material having a tray with a bottom wall panel. The bottom wall panel has a front edge, a pair of side edges and a rear edge. A front wall is hingedly joined to the front edge. A first side wall is hingedly joined to one of said side edges and a second side wall is hingedly joined to the other of said side edges. A rear wall is hingedly joined to the rear edge. Each of the front wall, the first and second side walls and the rear wall are configured to be folded to a position that is perpendicular to the bottom wall panel. Locations on the front wall and the rear wall that are mutually adjacent the first and second side walls each have a triangular piece hingedly joined thereto and to a respective one of the first and second side walls. Each triangular piece is configured to be oriented perpendicular to respective first and second side walls and parallel to respective front and rear walls, all in response to each of the front, rear and first and second side walls becoming oriented perpendicular to the bottom wall panel. A first flap is hingedly joined to the front wall along an edge that is remote from the edge that is hingedly joined to the front edge and is configured to be oriented parallel to the bottom wall panel. A slit extends coextensively along the hinge joining the first flap to the front wall. At least the front wall has a cut-out that opens into the slit at a mid-length thereof. A lid panel is hingedly joined to the rear wall along an edge that is remote from the edge that is hingedly joined to the rear edge and configured to overlay the tray and the bottom wall panel. A second flap is hingedly joined to the lid panel along an edge that is remote from the edge that is hingedly joined to the rear wall. The second flap is configured to be oriented perpendicular to the lid panel and extend through the slit when the lid panel becomes oriented parallel to the bottom wall panel and overlays the tray, the upwardly facing surface of the first flap and the bottom wall panel.

BRIEF DESCRIPTION OF THE DRAWINGS

Other objects and purposes of this invention will be apparent to persons acquainted with containers of this general type upon reading the following specification and inspecting the accompanying drawings, in which.

DETAILED DESCRIPTION

Figure 1:
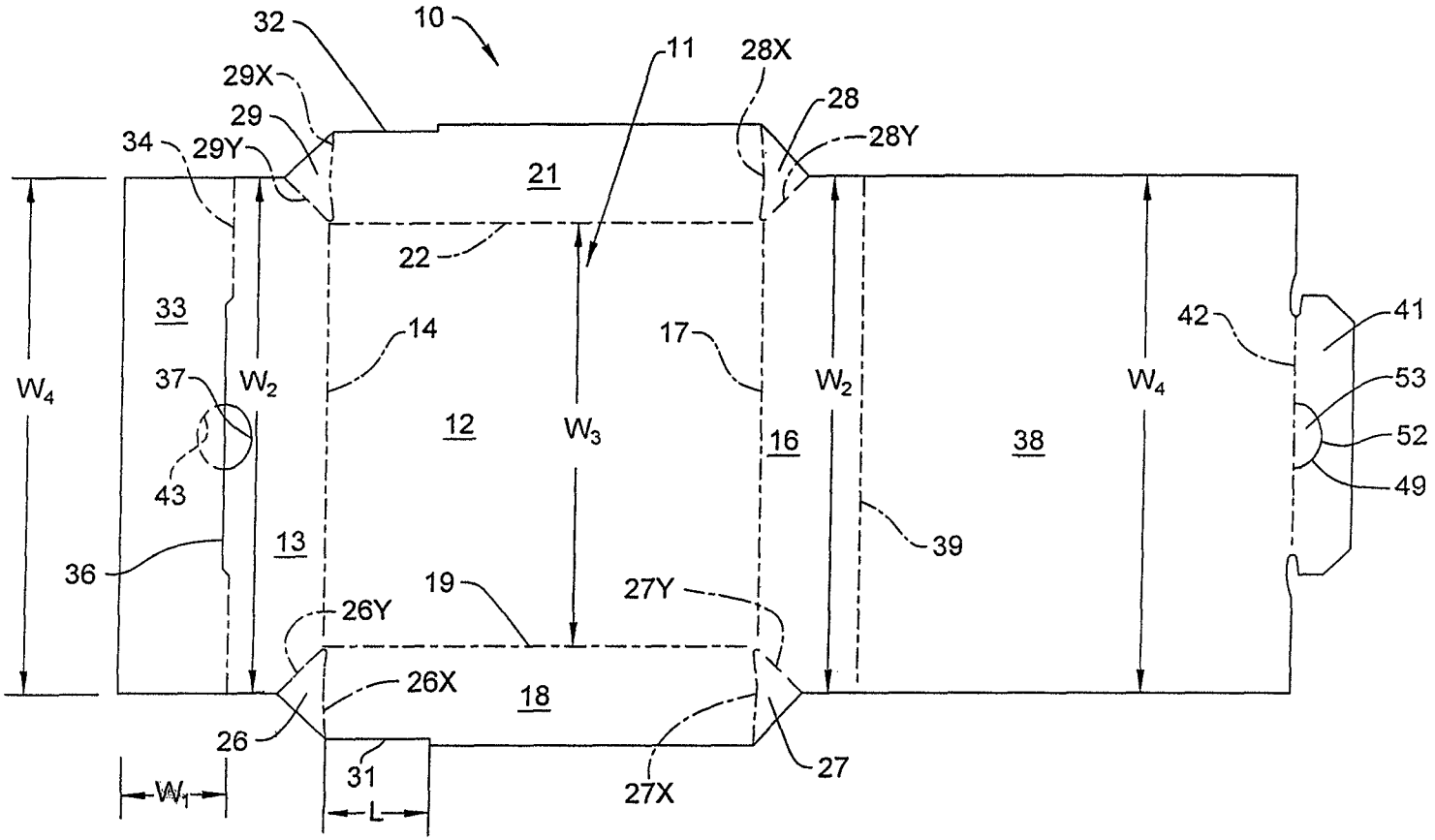
FIG. 1 is a plan view of a one-piece blank made of foldable material.

Certain terminology will be used in the following description for convenience in reference only and will not be limiting. The words "up", "down", "left" and "right" will designate directions in the drawings to which reference is made. The words "front" and "rear" will designate the front of the container facing to the left in FIG. 2 and the rear of the container facing to the right in FIG. 2. Such terminology will include derivatives and words of similar import.

Figure 2:
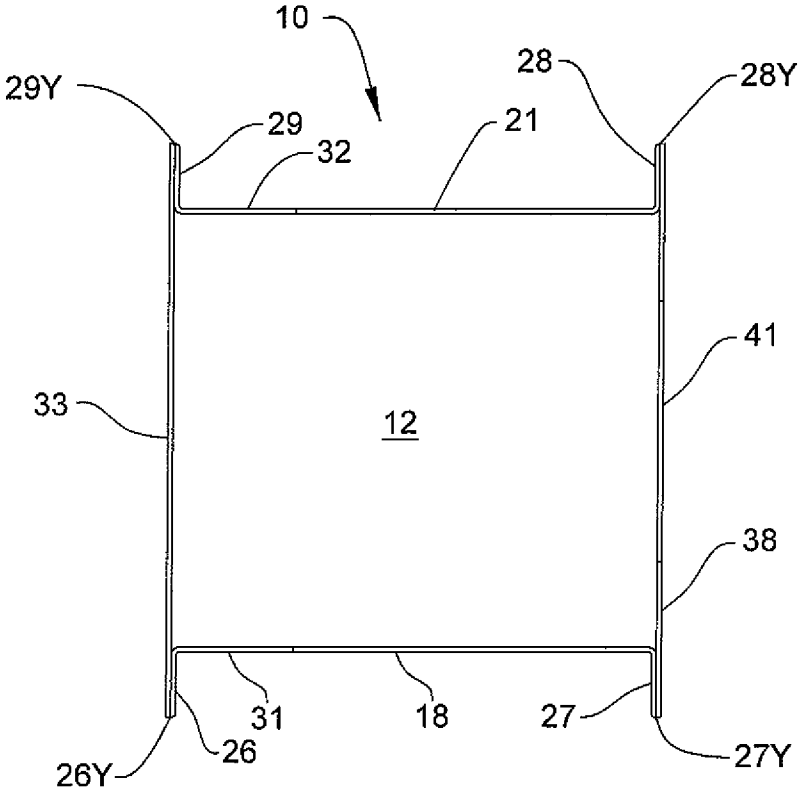
FIG. 2 is a top view of a container formed from the blank illustrated in FIG. 1.
Figure 3:
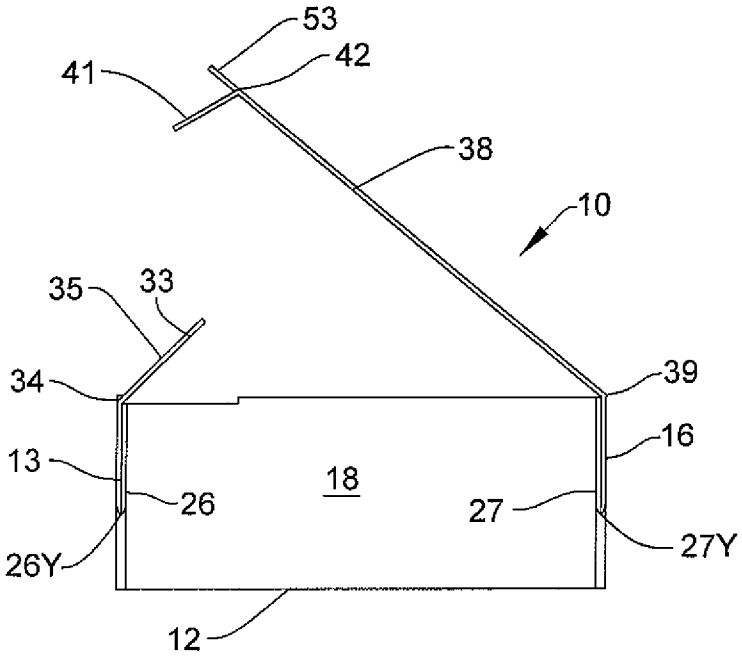
FIG. 3 is a side view of the container.

A first embodiment of a fully erected one-piece, four wall container 10 is illustrated in FIGS. 1-3 and is made of a foldable material having a tray 11 with a bottom wall panel 12. If desired, the side of the foldable material on which the tray is oriented can be coated with a conventional substance to render it impermeable to liquid. The bottom wall panel 12 has a front edge 14, a pair of side edges 19 and 22 and a rear edge 17. A front wall 13 is hingedly joined to the front edge 14. A first side wall 18 is hingedly joined to one of the side edges 19 and a second side wall 21 is hingedly joined to the other of said side edges 22. A rear wall 16 is hingedly joined to the rear edge 17. Each of the front wall 13, the first and second side walls 18 and 21 and the rear wall 16 are configured to be folded to a position that is perpendicular to the bottom wall panel 12 as illustrated in FIGS. 2 and 3.

Locations on the front wall 13 and the rear wall 16 that are mutually adjacent the first and second side walls 18 and 21 each have a respective triangular piece 26, 27, 28 and 29 hingedly joined thereto and to a respective one of the first and second side walls 18 and 21. Each triangular piece 26, 27, 28 and 29 is configured to be oriented perpendicular to respective first and second side walls 18 and 21 and parallel to respective front and rear walls 13 and 16 as shown in FIGS. 2 and 3, all in response to each of the front, rear and first and second side walls becoming oriented perpendicular to the bottom wall panel 12. More specifically, the triangular piece 26 is hingedly joined to the side wall 18 by a scoring as at 26X of the foldable material and by a scoring as at 26Y to the front wall 13. Similarly, the triangular piece 29 is hingedly joined to the side wall 21 by a scoring as at 21X of the foldable material and by a scoring as at 21Y to the front wall 13. The triangular piece 27 is hingedly joined to the side wall 18 by a scoring as at 27X of the foldable material and by a scoring as at 27Y to the rear wall 16. Similarly, the triangular piece 28 is hingedly joined to the side wall 21 by a scoring as at 28X of the foldable material and by a scoring as at 28Y to the rear wall 16. It is important that there be no perforations within the scorings 26X, 26Y, 27X, 27Y, 28X, 28Y, 29X and 29Y. Furthermore, when the triangular pieces 26, 27, 28, and 29 are folded to a position where they extend perpendicular to the side walls 18 and 21, the outer end of the respective scorings 26X, 26Y, 27X, 27Y, 28X, 28Y, 29X and 29Y become positioned above the plane of the bottom wall panel 12 so as to prevent spillage of the liquid from the tray 11 should the tray become slightly tilted relative to the horizontal.

Each of the first and second side walls 18 and 21 has an upwardly opening notch 31, 32 of finite length "L" oriented along an edge thereof that is remote from the edge hingedly joined to the side edges 19 and 22. Each notch 31, 32 also opens sideward to oppose the front wall 13 when the front wall has been oriented perpendicular to the bottom wall panel 12 as illustrated in FIG. 3.

Figure 7:
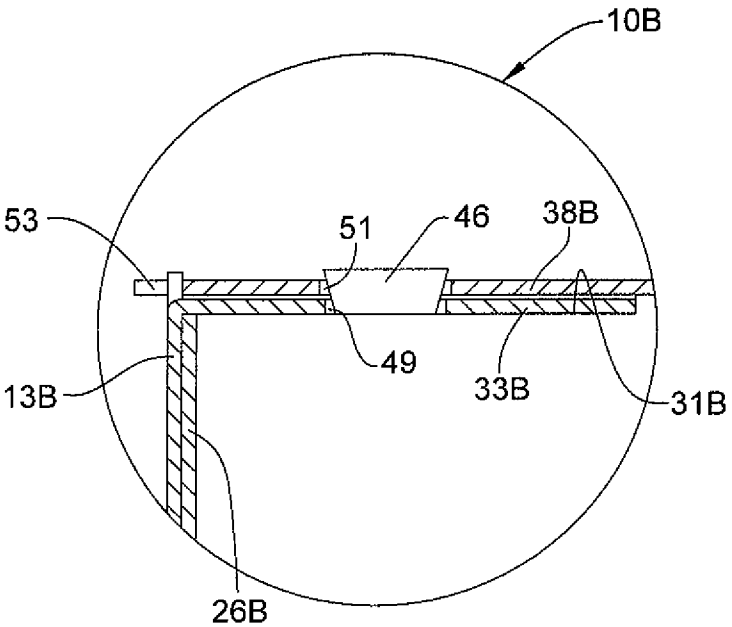
FIG. 7 is an enlarged fragment of FIG. 6.

A first flap 33 is hingedly joined as at 34 to the front wall 13 along an edge that is remote from the edge that is hingedly joined to the front edge 14. The first flap 33 has a finite width $W_1$ corresponding to the finite length L of the upwardly opening notch so that the first flap 33 will be received into the upwardly opening notch in response to the first flap being oriented parallel to the bottom wall panel 12 to thereby make an upwardly facing surface 35 (FIG. 3) of the first flap 33 flush with an upper edge 35 of each of the first and second side walls 18 and 21 as illustrated in FIG. 7.

A slit 36 extends coextensively along the hinge 34 joining the first flap 33 to the front wall 13. At least the front wall 13 has a cut-out 37 that opens into the slit at a mid-length thereof. If desired, the first flap 33 can also be provided with a cut-out 43 located on an opposite side of the slit 36 and opposes the cut-out 37.

A lid panel 38 is hingedly joined to the rear wall 16 along an edge 39 that is remote from the edge that is hingedly joined to the rear edge 17 and configured to overlay the tray 11 and bottom wall panel 12. A second flap 41 is hingedly joined to the lid panel 38 along an edge 42 that is remote from the edge 39 that is hingedly joined to the rear wall 16. The second flap 41 is configured to be oriented perpendicular to the lid panel 38 and extend through the slit 36 when the lid panel 38 becomes oriented parallel to the bottom wall panel 12 and overlays the tray 11 and the upwardly facing surface 35 of the first flap 33.

The front wall 13 and the rear wall 16 each have a first width dimension $W_2$ and the bottom wall panel 12 has a corresponding second width dimension $W_3$. The first flap 33 and the lid panel 38 have a third width dimension $W_4$. In the embodiment of FIG. 1, dimensions $W_2$ and $W_4$ are the same.

Figure 4:
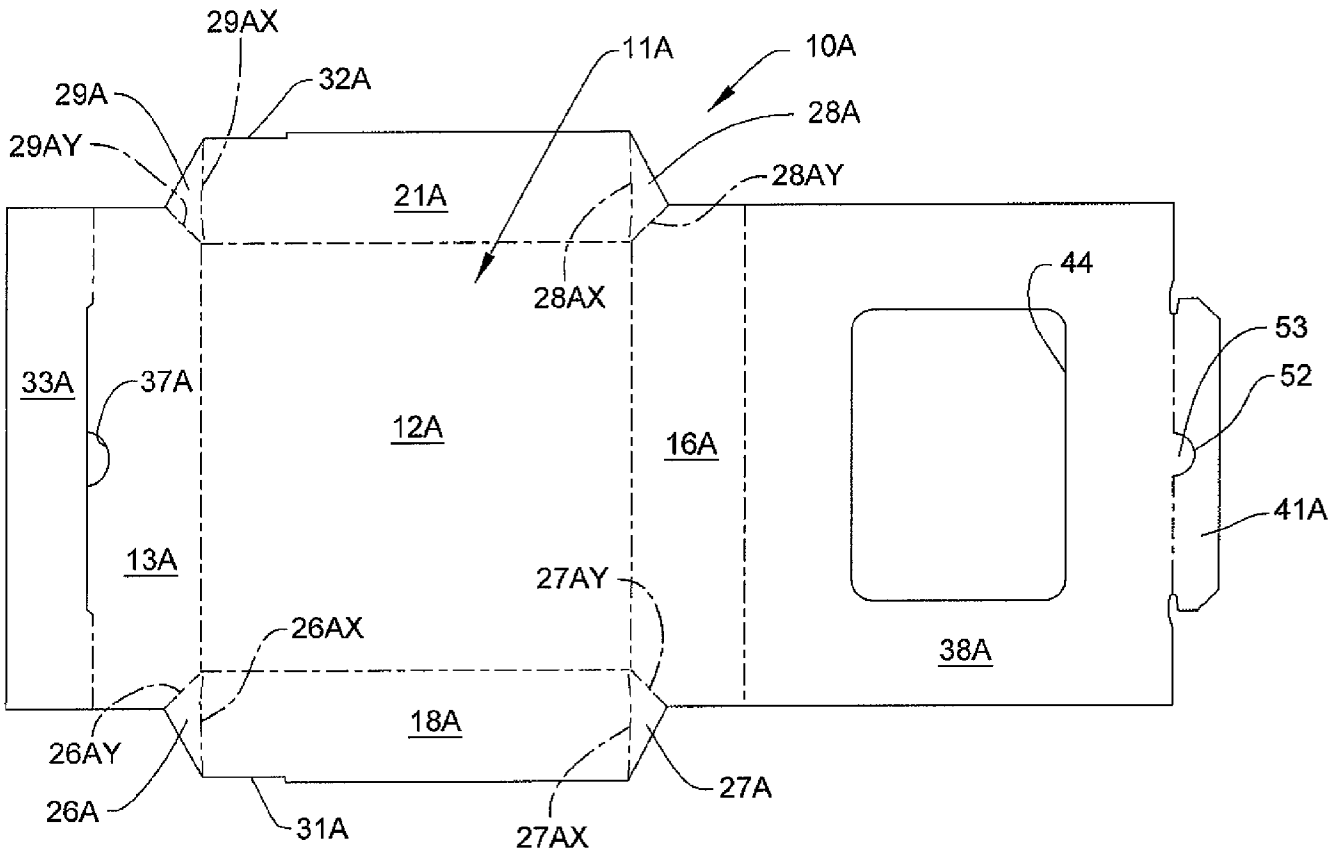
FIG. 4 is a plan view of a modified one-piece blank made of foldable material.

An embodiment of a first modified container 10A is illustrated in FIG. 4. Since the container 10A is essentially identical to the container 10, some of the reference numbers used to describe the embodiment of FIGS. 1-3 have been incorporated into FIG. 4 but with the suffix "A" added thereto. In this embodiment, an opening or window 44 is provided in the lid panel 38A and is preferably central to the lid panel 38A.

Figure 5:
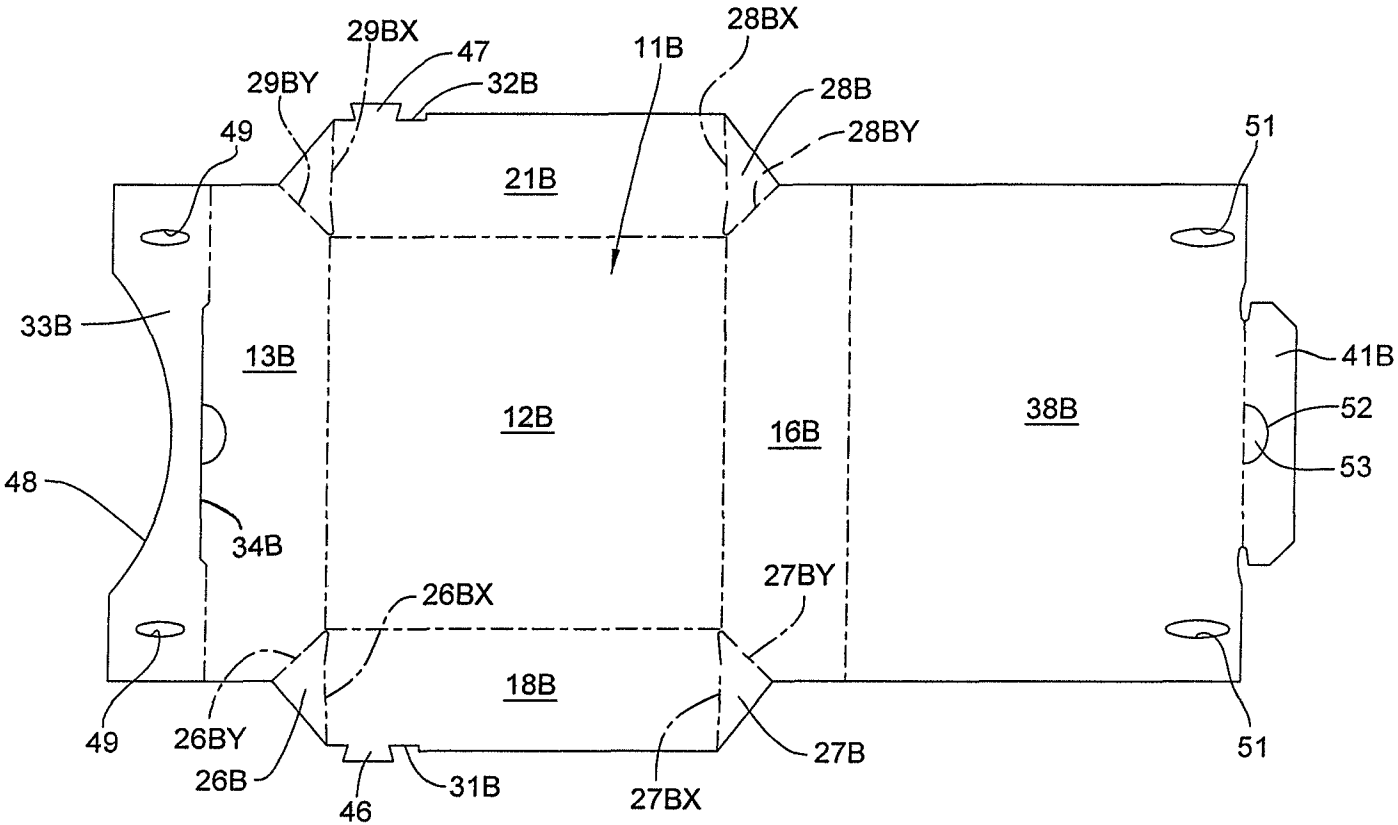
FIG. 5 is a plan is plan view of a further modified one-piece blank made of a foldable material.
Figure 6:
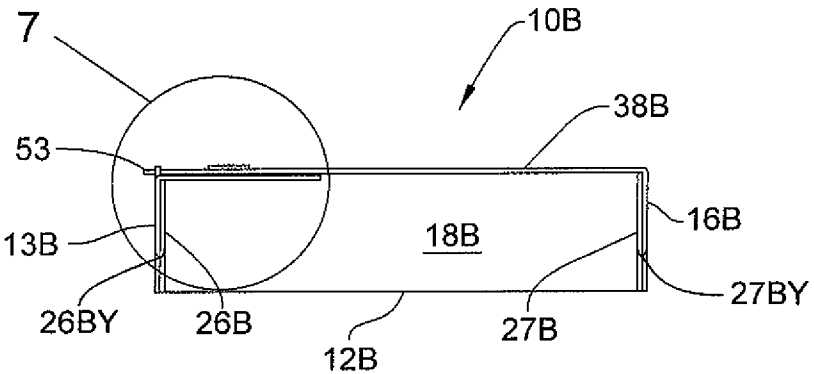
FIG. 6 is a side view of the modified container formed from the blank illustrated in FIG. 4.

An embodiment of a second modified container 10B is illustrated in FIGS. 5 to 7. Since the container 10B is essentially identical to the container 10, some of the reference numbers used to describe the embodiment of FIGS. 1-3 have been incorporated into FIGS. 5 to 7 but with the suffix "B" added thereto. In this embodiment, a trapezoidal piece 46 and 47 is provided on each of the first and second side walls 18B and 21B and is oriented within said upwardly opening notch 31B, 32B. An upper end of each trapezoidal piece 46, 47 has a width that is greater than a width whereat said trapezoidal piece joins to respective said first and second side walls 18B and 21B. The first flap 33B and the lid panel each have a pair of cut-outs 49 and 51, respectively, that are each configured to be aligned with and receive therein a respective trapezoidal piece 46, 47 so as to lock the first flap 33B into the upwardly facing notch 31B, 32B and lock the lid panel 38B in the position that is parallel to and overlaying the tray 11B and the bottom wall panel 12B as illustrated in FIG. 7. Furthermore, the first flap 33B has a notch 48 provided in an edge remote from the edge 34B hingedly joining the first flap 33B to the front wall 13B. The notch 48 serves to increase the access space to the tray 11B when the first flap 33B has been oriented in a position parallel to the bottom wall panel 12B and received in the notches 31B, 32B in the upper edge of the side walls 18B and 21B, respectively.

Figure 8:
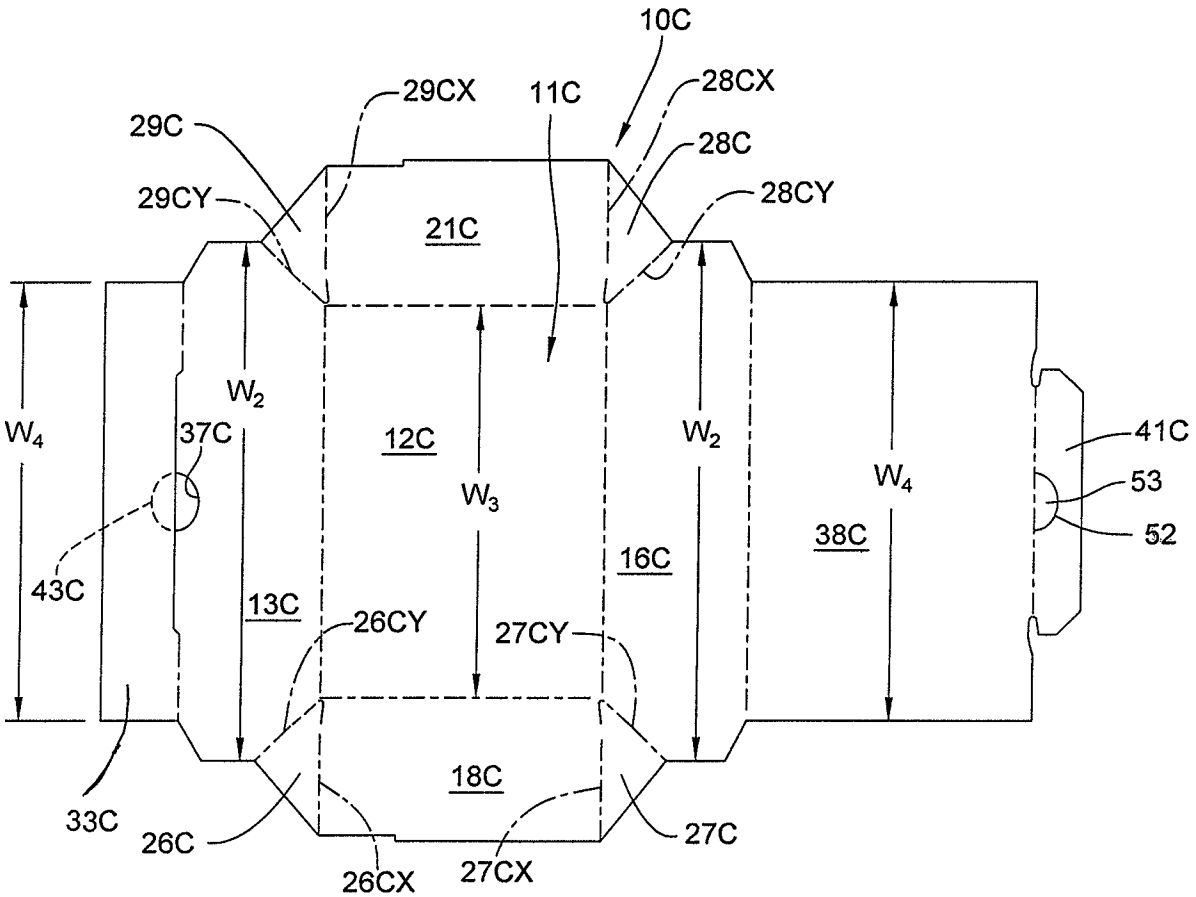
FIG. 8 is a plan view of a still further modified one-piece blank made of a foldable material.

An embodiment of a third modified container 100 is illustrated in FIG. 8. Since the container 100 is essentially identical to the container 10, some of the reference numbers used to describe the embodiment of FIGS. 1-3 have been incorporated into FIG. 8 but with the suffix "C" added thereto. In this embodiment, dimension $W_2$ is greater than dimension $W_4$.

In each embodiment described above, the second flaps 41, 41A, 41B and 41C each have a arcuate slit 52 therein on a side of the hinged joint 42 that is remote from the respective lid panel 38, 38A, 38B and 38C to form a tab 53 that is configured to remain coplanar with the respective lid panels 38, 38A, 38B and 38C when the second flaps 41, 41A, 41B and 41C are each oriented perpendicular to the respective lid panels 38, 38A, 38B and 38C.

Although particular preferred embodiments of the invention have been disclosed in detail for illustrative purposes, it will be recognized that variations or modifications of the disclosed container lie within the scope of the present invention.

What is claimed is:

1. A fully erected one-piece, four wall container made of a foldable material, comprising:

a tray having a bottom wall panel, said bottom wall panel having a front edge, a pair of side edges and a rear edge, a planar front wall hingedly joined to said front edge at a front bottom edge, a planar first side wall hingedly joined to one of said side edges at a first side bottom edge, a planar second side wall hingedly joined to the other of said side edges at a second side bottom edge, a planar rear wall hingedly joined to said rear edge at a rear bottom edge, each of said front wall, said first and second side walls and said rear wall being configured to be folded to a position that is perpendicular to said bottom wall panel, locations on said front wall and said rear wall that are mutually adjacent said first and second side walls each having a planar triangular piece having only three substantially straight edges hingedly joined thereto and hingedly joined to a respective one of said first and second side walls, each said triangular piece being configured to be oriented perpendicular to respective said first and second side walls and parallel to respective said front and rear walls, all in response to each of said front, rear and first and second side walls becoming oriented perpendicular to said bottom wall panel;

a first flap hingedly joined to said front wall along an edge that is remote from said front bottom edge that is hingedly joined to said front edge;

a slit extending coextensively along the hinge joining said first flap to said front wall, at least said front wall having a cut-out that opens into said slit;

a lid panel hingedly joined to said rear wall along a rear top edge that is remote from said rear bottom edge that is hingedly joined to said rear edge and configured to overlay said tray and said bottom wall panel; and a second flap hingedly joined to said lid panel along an edge that is remote from said rear top edge that is hingedly joined to said rear wall, said second flap being configured to be oriented perpendicular to said lid panel and extending through said slit when said lid panel becomes oriented parallel to said bottom wall panel and overlays said tray and an upwardly facing surface of said first flap;

wherein the front wall, the first side wall, the second side wall and the rear wall define sides of a rectangular boundary coextensive with a periphery of the bottom wall panel and the triangular pieces extend outside of the rectangular boundary; and wherein said front wall and said rear wall each have a first width dimension, said bottom wall panel has a second width dimension, and said first flap and said lid panel have a third width dimension, with said first and third width dimensions being the same.

2. The container according to claim 1, wherein each of said front wall and said first flap has a cut-out located on opposite sides of said slit and opposite to one another, with ends of each of the cut-outs terminating at the slit.

3. The container according to claim 1, wherein said lid panel has an opening therein to expose said bottom wall panel when said lid panel overlays said bottom wall panel.

4. The container according to claim 1, wherein said second flap has an arcuate slit therein on a side of said hinged joint that is remote from said lid panel to form a tab that is configured to remain coplanar with said lid panel when said second flap is oriented perpendicular to said lid panel.

5. The container according to claim 1, wherein the side of the foldable material on which the tray is oriented is coated with a substance to render it impermeable to liquid.

6. The container according to claim 1, wherein said front wall, said first side wall, said second side wall, said rear wall and said triangular pieces are planar and are unfolded.

7. The container according to claim 1, wherein all of the triangular pieces have a substantially identical shape.

8. A fully erected one-piece, four wall container made of a foldable material, comprising:

a tray having a bottom wall panel, said bottom wall panel having a front edge, a pair of side edges and a rear edge, a planar front wall hingedly joined to said front edge at a front bottom edge, a planar first side wall hingedly joined to one of said side edges at a first side bottom edge, a planar second side wall hingedly joined to the other of said side edges at a second side bottom edge, a planar rear wall hingedly joined to said rear edge at a rear bottom edge, each of said front wall, said first and second side walls and said rear wall being configured to be folded to a position that is perpendicular to said bottom wall panel, locations on said front wall and said rear wall that are mutually adjacent said first and second side walls each having a planar triangular piece having only three substantially straight edges hingedly joined thereto and hingedly joined to a respective one of said first and second side walls, each said triangular piece being configured to be oriented perpendicular to respective said first and second side walls and parallel to respective said front and rear walls, all in response to each of said front, rear and first and second side walls becoming oriented perpendicular to said bottom wall panel;

a first flap hingedly joined to said front wall along an edge that is remote from said front bottom edge that is hingedly joined to said front edge;

a slit extending coextensively along the hinge joining said first flap to said front wall, at least said front wall having a cut-out that opens into said slit;

a lid panel hingedly joined to said rear wall along a rear top edge that is remote from said rear bottom edge that is hingedly joined to said rear edge and configured to overlay said tray and said bottom wall panel; and a second flap hingedly joined to said lid panel along an edge that is remote from said rear top edge that is hingedly joined to said rear wall, said second flap being configured to be oriented perpendicular to said lid panel and extending through said slit when said lid panel becomes oriented parallel to said bottom wall panel and overlays said tray and an upwardly facing surface of said first flap;

wherein the front wall, the first side wall, the second side wall and the rear wall define sides of a rectangular boundary coextensive with a periphery of the bottom wall panel and the triangular pieces extend outside of the rectangular boundary; and wherein said front wall and said rear wall each have a first width dimension, said bottom wall panel has a second width dimension, and said first flap and said lid panel have a third width dimension, with said first width dimension being greater than said third width dimension.

9. A fully erected one-piece, four wall container made of a foldable material, comprising:

a tray having a bottom wall panel, said bottom wall panel having a front edge, a pair of side edges and a rear edge, a planar front wall hingedly joined to said front edge at a front bottom edge, a planar first side wall hingedly joined to one of said side edges at a first side bottom edge, a planar second side wall hingedly joined to the other of said side edges at a second side bottom edge, a planar rear wall hingedly joined to said rear edge at a rear bottom edge, each of said front wall, said first and second side walls and said rear wall being configured to be folded to a position that is perpendicular to said bottom wall panel, locations on said front wall and said rear wall that are mutually adjacent said first and second side walls each having a planar triangular piece having only three substantially straight edges hingedly joined thereto and hingedly joined to a respective one of said first and second side walls, each said triangular piece being configured to be oriented perpendicular to respective said first and second side walls and parallel to respective said front and rear walls, all in response to each of said front, rear and first and second side walls becoming oriented perpendicular to said bottom wall panel;

a first flap hingedly joined to said front wall along an edge that is remote from said front bottom edge that is hingedly joined to said front edge;

a slit extending coextensively along the hinge joining said first flap to said front wall, at least said front wall having a cut-out that opens into said slit;

a lid panel hingedly joined to said rear wall along a rear top edge that is remote from said rear bottom edge that is hingedly joined to said rear edge and configured to overlay said tray and said bottom wall panel; and a second flap hingedly joined to said lid panel along an edge that is remote from said rear top edge that is hingedly joined to said rear wall, said second flap being configured to be oriented perpendicular to said lid panel and extending through said slit when said lid panel becomes oriented parallel to said bottom wall panel and overlays said tray and an upwardly facing surface of said first flap;

wherein the front wall, the first side wall, the second side wall and the rear wall define sides of a rectangular boundary coextensive with a periphery of the bottom wall panel and the triangular pieces extend outside of the rectangular boundary; and wherein each said first and second side walls have an upwardly opening notch of finite length oriented along an edge thereof that is remote from said first and second side bottom edges hingedly joined to said side edges, said notch also opening sideward to oppose said front wall when said front wall has been oriented perpendicular to said bottom wall panel, said first flap having a finite width corresponding to said finite length of said upwardly opening notch so that said first flap will be received into said upwardly opening notch in response to said first flap being oriented parallel to said bottom wall panel to thereby make an upwardly facing surface of said first flap flush with an upper edge of each of said first and second side walls.

10. A fully erected one-piece, four wall container made of a foldable material, comprising:

a tray having a bottom wall panel, said bottom wall panel having a front edge, a pair of side edges and a rear edge, a planar front wall hingedly joined to said front edge at a front bottom edge, a planar first side wall hingedly joined to one of said side edges at a first side bottom edge, a planar second side wall hingedly joined to the other of said side edges at a second side bottom edge, a planar rear wall hingedly joined to said rear edge at a rear bottom edge, each of said front wall, said first and second side walls and said rear wall being configured to be folded to a position that is perpendicular to said bottom wall panel, locations on said front wall and said rear wall that are mutually adjacent said first and second side walls each having a planar triangular piece having only three substantially straight edges hingedly joined thereto and hingedly joined to a respective one of said first and second side walls, each said triangular piece being configured to be oriented perpendicular to respective said first and second side walls and parallel to respective said front and rear walls, all in response to each of said front, rear and first and second side walls becoming oriented perpendicular to said bottom wall panel;

a first flap hingedly joined to said front wall along an edge that is remote from said front bottom edge that is hingedly joined to said front edge;

a slit extending coextensively along the hinge joining said first flap to said front wall, at least said front wall having cut-out that opens into said slit;

a lid panel hingedly joined to said rear wall along a rear top edge that is remote from said rear bottom edge that is hingedly joined to said rear edge and configured to overlay said tray and said bottom wall panel; and a second flap hingedly joined to said lid panel along an edge that is remote from said rear top edge that is hingedly joined to said rear wall, said second flap being configured to be oriented perpendicular to said lid panel and extending through said slit when said lid panel becomes oriented parallel to said bottom wall panel and overlays said tray and an upwardly facing surface of said first flap;

wherein the front wall, the first side wall, the second side wall and the rear wall define sides of a rectangular boundary coextensive with a periphery of the bottom wall panel and the triangular pieces extend outside of the rectangular boundary; and wherein said first and second side walls each have an upwardly opening notch in an edge that is remote from said first and second side bottom edges that are hingedly joined to said side edges of said bottom wall panel.

11. The container according to claim 10, wherein a trapezoidal piece is provided on each of said first and second side walls and is oriented within said upwardly opening notch, an upper end of said trapezoidal piece having a width that is greater than a width whereat said trapezoidal piece joins to respective said first and second side walls, said first flap and said lid panel each having a pair of cut-outs that are each configured to be aligned with and receive therein a said trapezoidal piece so as to lock said first flap into said upwardly facing notch and lock said lid panel in said position that is parallel to and overlaying said bottom wall panel.

12. The container according to claim 10, wherein said first flap has an access notch in an edge thereof remote from said front wall so that said first flap will not obstruct access to said bottom wall panel when said first flap is oriented parallel to said bottom wall panel and received in said upwardly opening notches in said first and second side walls.

* * * * *